US006923160B2

(12) United States Patent
Wirkowski et al.

(10) Patent No.: US 6,923,160 B2
(45) Date of Patent: Aug. 2, 2005

(54) HIGH-PRESSURE FUEL RESERVOIR FOR A RESERVOIR INJECTION SYSTEM

(75) Inventors: Michael Wirkowski, Regensburg (DE); Eckbert Zander, Bad Suderode (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/794,296

(22) Filed: Mar. 5, 2004

(65) Prior Publication Data

US 2004/0168675 A1 Sep. 2, 2004

Related U.S. Application Data

(63) Continuation of application No. PCT/DE02/03273, filed on Sep. 4, 2002.

(30) Foreign Application Priority Data

Sep. 5, 2001 (DE) ..... 101 43 519

(51) Int. Cl.[7] ..... F02M 33/04
(52) U.S. Cl. ..... 123/456; 123/468
(58) Field of Search ..... 123/456, 468, 123/469

(56) References Cited

U.S. PATENT DOCUMENTS 6,317,975 B1 * 11/2001 Asada et al. ..... 29/888.01
6,470,856 B1 * 10/2002 Boecking ..... 123/456
6,505,607 B1 * 1/2003 Mattes ..... 123/456
6,612,289 B1 * 9/2003 Frank et al. ..... 123/456
6,634,335 B2 * 10/2003 Boecking et al. ..... 123/456
6,640,783 B2 * 11/2003 Braun et al. ..... 123/467
6,666,188 B2 * 12/2003 Knoedl et al. ..... 123/456
6,725,839 B2 * 4/2004 Zdroik et al. ..... 123/456

FOREIGN PATENT DOCUMENTS

| | | | | |
|---|---|---|---|---|
| DE | 19808894 A1 | 9/1998 | ..... | F16L/41/04 |
| DE | 19945786 C1 | 11/2000 | ..... | F02M/55/02 |
| DE | 19945316 A1 | 4/2001 | ..... | F02M/55/02 |
| DE | 19948338 A1 | 4/2001 | ..... | F02M/55/02 |
| WO | 01/25616 A1 | 4/2001 | ..... | F02M/55/02 |

OTHER PUBLICATIONS

PCT International Search Report Application No. PCT/DE02/03273.

* cited by examiner

*Primary Examiner*—Thomas Moulis
(74) *Attorney, Agent, or Firm*—Baker Botts L.L.P.

(57) ABSTRACT

The invention relates to a high pressure fuel accumulator for an accumulator injection system in internal injection engines, comprising a base body which is provided with a longitudinal recess which has a plurality of connecting bores emanating therefrom. The inner chamber of the longitudinal recess is essentially cylindrical in shape and has at least one rib shaped section on the inner perimeter of the longitudinal recess into which a connecting bore formed in the longitudinal recess leads.

11 Claims, 1 Drawing Sheet

HIGH-PRESSURE FUEL RESERVOIR FOR A RESERVOIR INJECTION SYSTEM

CROSS-REFERENCE TO RELATED APPLICATION

This application is a continuation of co-pending International Application No. PCT/DE02/03273 filed Sep. 4, 2002 which designates the United States, and claims priority to German application number DE10143519.3 filed Sep. 5, 2001.

TECHNICAL FIELD OF THE INVENTION

The present invention relates to a high-pressure fuel reservoir for a reservoir injection system for use in internal combustion engines, in particular for common-rail systems.

BACKGROUND OF THE INVENTION

In reservoir injection systems, a high-pressure pump propels the fuel to be injected from a tank into a central high-pressure fuel reservoir (rail). From this rail, individual fuel lines lead to the respective injectors of the cylinders of the internal combustion engine. The injectors are triggered individually as a function of the engine operating parameters of the internal combustion engine in order to inject fuel into the respective combustion chamber. FIGS. 3 and 4 show a high-pressure fuel reservoir according to the prior art. As can be seen in the figures, the high-pressure fuel reservoir comprises a base body 1 which has a longitudinal bore 3, from which there branch off a plurality of connection bores 2 for the injectors. Since the reservoir injection systems operate at very high pressures, strength problems occur in particular at the transitional areas, indicated by arrows in FIG. 3, between the longitudinal bore 3 and the connection bores 2, which problems lead to cracks there which rapidly become enlarged. For this reason, very expensive, highly resistant materials are used for the base body 1 in the prior art, and complex and time-consuming aftertreatment steps are performed at the points at risk from cracking, such as e.g. deburring or shot peening. As a result, the known high-pressure fuel reservoirs are very labor-intensive and expensive to manufacture.

DE-199 45 786 C1 also discloses a high-pressure fuel reservoir in which an inner chamber is formed from two circular cylindrical recesses which are disposed parallel to each other in the longitudinal direction and are connected to each other. In this arrangement the connection bores for the injectors are disposed in a connection area which is provided between the two longitudinal bores and is in the form of a saddle. By this means favorable stress ratios can be generated at the transitional area between the longitudinal bore and the connection bore. This high-pressure fuel reservoir does, however, have a relatively large width due to the parallel arrangement of the two longitudinal bores. Moreover, the manufacture of the two parallel bores, e.g. by means of deep-hole drilling, is very complex and expensive.

SUMMARY OF THE INVENTION

The object of the present invention is therefore to provide, by a method that permits both easy and cost-effective manufacture, a high-pressure fuel reservoir for a reservoir injection system, said reservoir having an improved high-pressure fatigue strength as well as being of compact design.

This object is achieved by a high-pressure fuel reservoir with the following features: a base having a longitudinal recess with an essentially cylindrically shaped inner surface, the recess having a plurality of connection bores branching therefrom, the inner circumference of the recess having at least one rib shaped section where the connection bores branch into the recess.

The high-pressure fuel reservoir according to the invention for a reservoir injection system with the above features is of particularly compact and space-saving design and has a significantly improved high-pressure fatigue strength at the transitional areas between an oblong recess and the connection bores for injectors of the injection system. At the same time the high-pressure reservoir according to the invention is constructed in such a way that a longitudinal recess provided in a base body is formed essentially in the shape of a cylinder and has at least one rib-shaped section on its inner circumference. According to the invention, the connection bores for the injectors lead at the rib-shaped section into the longitudinal recess. The rib-shaped section is implemented pointing inward in the longitudinal recess, thus resulting in favorable stress ratios being obtained particularly at the end of the rib-shaped section, so that the stresses at the bore intersections can be reduced. The rib-shaped inward projecting lug thus positions the intersection in the direction of the central axis of the essentially cylindrical longitudinal recess, with the result that the tangential stresses or circumferential stresses at the intersection are considerably smaller. By this means it is possible according to the invention that less expensive materials can be used for the high-pressure reservoirs or, alternatively, that the high-pressure reservoirs can be used for even higher pressures. In particular the pressure pulse strength can also be increased further by the inventive embodiment of the high-pressure reservoir.

It is particularly preferable if the rib-shaped section is embodied on the inner circumference of the longitudinal recess such that it extends over the entire length of the base body. By this means it is possible for example that the high-pressure reservoir according to the invention can be manufactured from drawn tubes, which results in a significant reduction in the cost of manufacture compared with the known high-pressure reservoirs.

According to a preferred embodiment of the present invention, a plurality of rib-shaped sections running parallel to one another are formed on the inner circumference of the base body. This enables the connection lines for the injectors or inlets/outlets to be disposed at different points on the circumference of the oblong base body. By this means greater degrees of freedom with regard to the arrangement of the lines in the generally confined engine compartments of motor vehicles.

Particularly preferably in this case, two rib-shaped sections are formed on the inner circumference, which sections are disposed opposite to each other. In this way an improved rigidity of the high-pressure fuel reservoir can also be achieved.

According to another particularly preferred embodiment of the present invention, three rib-shaped sections are formed on the inner circumference of the base body. In this arrangement the three rib-shaped sections are disposed offset by 120° with respect to one another in each case. By this means the stability of the high-pressure reservoir can be improved further.

Owing to the arrangement of a plurality of rib-shaped sections on the inner circumference of the base body it can further be achieved that, depending on the number of rib-shaped sections, a plurality of connection bores can be disposed in one sectional plane, i.e. at one height in the longitudinal direction of the base body.

Preferably an acute angle is formed at the transition between the connection bore and the rib-shaped section. In this way the stresses can be kept very low.

In order to obtain particularly favorable stress ratios, i.e. very low stresses, at the bore intersection between the longitudinal recess and the connection bores, the rib-shaped sections are preferably embodied with a rounded contour. In a particularly preferred embodiment, the projecting end of the rib-shaped sections is here formed as semicircular in section, whereby the connection bore is led through the furthest projecting area of the rib-shaped section.

BRIEF DESCRIPTION OF THE DRAWINGS

The invention is described below with reference to preferred exemplary embodiments in conjunction with the drawings, in which.

DETAILED DESCRIPTION OF THE PREFERRED EMBODIMENTS OF THE INVENTION

Figure 1:
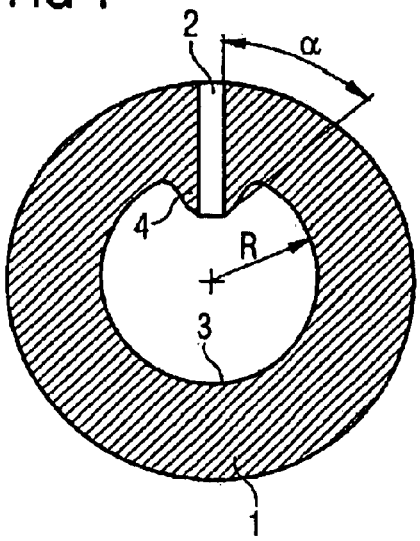
FIG. 1 shows a schematic sectional view of a high-pressure fuel reservoir according to a first exemplary embodiment of the present invention.

A first exemplary embodiment according to the present invention is described below with reference to FIG. 1. As shown in FIG. 1, the high-pressure fuel reservoir comprises a base body 1 which is embodied as an oblong shape and from which a plurality of connection bores 2 branch off, which bores lead to injectors at individual cylinders of an internal combustion engine. Here, the base body 1 is formed with an inner longitudinal bore 3 which is essentially cylindrical in shape. On the inner circumference of the longitudinal bore 3, there is formed a rib-shaped section 4 which extends over the entire length of the base body 1. The radius R of the essentially cylindrical bore is chosen here such that the necessary reservoir volume is provided in spite of the reduction in volume due to the inward oriented rib-shaped section 4.

As can be seen from FIG. 1, the connection bore 2 is disposed here on the base body 1 in such a way that the connection bore 2 is led through the rib-shaped section 4 and the bore intersection between the longitudinal bore 3 and the connection bore 2 is disposed at the end of the rib-shaped section 4. In this case the rib-shaped section 4 is formed in such a way that its end describes a semicircle in section, such that an acute angle $\alpha$ is produced at the point of intersection, i.e. transitional area, between the bore 2 and the rib-shaped section 4.

The arrangement of the connection bore 2 on the rib-shaped section 4 achieves a favorable distribution of stresses, since the pressure prevailing in the base body 1 acts from both sides on the rib-shaped section 4, so that the resulting forces at the bore intersection are considerably reduced. Also significant is that the influence of the tangential stress or circumferential stress of the longitudinal bores is less at the intersection. As a result, the risk of a crack forming at the transitional area between the connection bore 2 and the longitudinal bore 3 is greatly reduced. This means that the high-pressure reservoir according to the invention can be used in particular for the higher pressures that are to be expected in the near future in fuel injection systems, or alternatively more cost-effective materials with lower high-pressure fatigue strength can be used for the high-pressure fuel reservoir.

A high-pressure fuel reservoir according to a second exemplary embodiment of the present invention is described below with reference to FIG. 2. Identical or functionally identical parts are identified here by the same reference characters as in the first exemplary embodiment.

Figure 2:
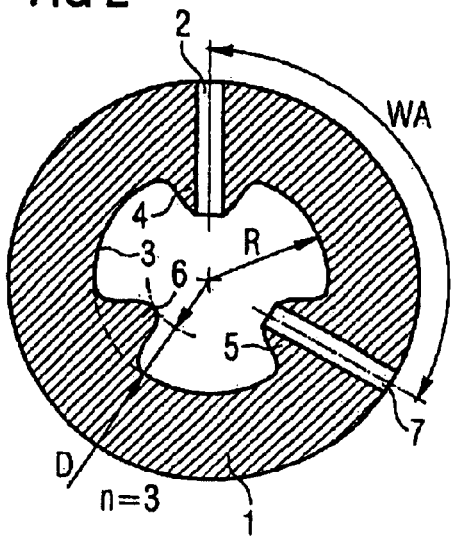
FIG. 2 shows a schematic sectional view of a high-pressure fuel reservoir according to a second exemplary embodiment of the present invention.
Figure 4:
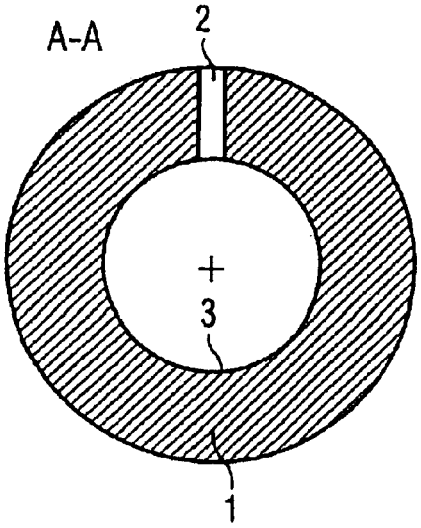
FIG 4 Prior art
FIG. 4 shows a sectional view along the line A—A of the high-pressure fuel reservoir according to the prior art from FIG. 3.
Figure 3:
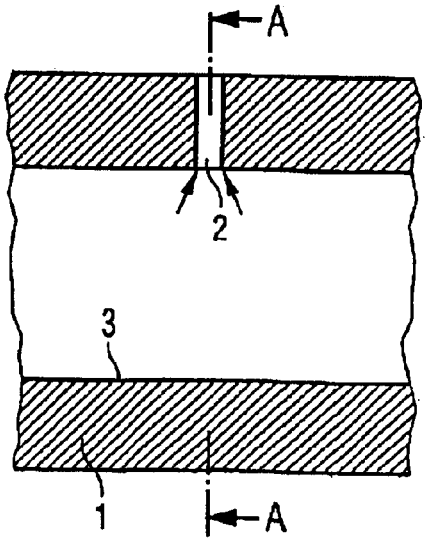
FIG 3 Prior art
FIG. 3 shows a schematic longitudinal sectional view of a high-pressure fuel reservoir according to the prior art.

As shown in FIG. 2, the high-pressure fuel reservoir according to the second exemplary embodiment likewise comprises an oblong base body 1 in which an end-to-end longitudinal recess 3 is formed.

In contrast to the first exemplary embodiment, in the second exemplary embodiment three rib-shaped sections 4, 5, 6 are formed on the inner circumference of the longitudinal recess 3. As shown in FIG. 2, the three rib-shaped sections 4, 5, 6 are each disposed offset at 120° around the inner circumference of the essentially cylindrical longitudinal recess 3. The rib-shaped sections 4, 5, 6 project into the longitudinal recess 3 and are formed rounded off at their ends.

As shown in FIG. 2, a first connection bore 2 is disposed such that the bore intersection is disposed with the longitudinal recess 3 on the first rib-shaped section 4. A second connection bore 7 is furthermore led through the second rib-shaped section 5 (cf. FIG. 2). By means of the arrangement of a plurality of rib-shaped sections 4, 5, 6 it is thus possible that the connection bores can be disposed in the longitudinal direction of the base body 1 at the same height at different positions around the circumference of the base body 1. In the high-pressure reservoir represented in FIG. 2, on the section shown two connection bores 2 and 7 are disposed at the same height in the longitudinal direction at different circumferential positions of the base body 1. This allows higher degrees of freedom in relation to the arrangement of the connection bores for the injectors or other inlet/outlet lines. By this means it is further possible that the total length of the base body 1 can be reduced compared with the prior art, since a plurality of bores can be distributed at the same height around the circumference of the base body 1. The radius R is chosen here such that the necessary reservoir volume is present.

Furthermore, the arrangement of three rib-shaped sections which are offset uniformly with respect to one another results in a particularly high stability of the high-pressure reservoir according to the invention.

The arrangement of a plurality of rib-shaped sections 4 which are offset uniformly with respect to one another around the inner circumference of the base body, which sections are thus disposed at the same angular distance with respect to one another on the inner surface of the longitudinal recess, results in a high degree of stability and a good drawability of the fuel tube.

The required radial connection bores 2, 7 can be introduced as required into one or more rib-shaped sections 4 that are offset with respect to one another, so that radial connection bores 2, 7 can be introduced at an angular distance WA of multiples k of (360°/n) (where n=number of rib-shaped sections):

$$WA=k*360°/n$$

Preferably the rib-shaped section 4, 5 projects inward by a distance D of more than 2 mm compared to the cylindrically conceived inner surface of the longitudinal recess, as a result of which a high degree of stability and low intrinsic stresses are achieved at high pressures of 1000 to 2500 bar in the fuel distributor, where the inner surface has an inner diameter of 7 to 15 mm.

In other respects the second exemplary embodiment corresponds to the first exemplary embodiment, so reference can be made to the description given there.

Thus, the present invention relates to a high-pressure fuel reservoir for a reservoir injection system for internal combustion engines having a base body 1 comprising a longitudinal recess 3 from which there branch off a plurality of connection bores 2, 7. In this arrangement the inner surface of the longitudinal recess 3 is embodied as an essentially cylindrical shape, whereby at least one rib-shaped section 4 is formed on the inner circumference of the longitudinal recess 3, in which section a connection bore 2 leads into the longitudinal recess 3.

The present invention is not restricted to the exemplary embodiments described. Different variations and adaptations can be implemented without departing from the scope of the invention.

What is claimed:

1. A high-pressure fuel reservoir for a reservoir injection system of an internal combustion engine, said reservoir having a base, said base having a longitudinal recess with an essentially cylindrically shaped inner surface, said recess having a plurality of connection bores branching therefrom wherein the inner circumference of the recess has a plurality of rib-shaped sections thereon.

2. A high-pressure fuel reservoir according to claim 1, wherein the rib-shaped section extends over the entire length of the base.

3. A high-pressure fuel reservoir according to claim 1, wherein two rib-shaped sections are formed on the inner circumference of the base and are disposed opposite to each other.

4. A high-pressure fuel reservoir according to claim 1, wherein three rib-shaped sections are formed on the inner circumference of the base and are each disposed offset at 120° with respect to one another.

5. A high-pressure fuel reservoir according to claim 1, wherein an acute angle ($\alpha$) is formed at the transition between a connection bore and the rib-shaped section.

6. A high-pressure fuel reservoir according to claim 1, wherein an end of the rib-shaped section is rounded.

7. A high-pressure fuel reservoir according to claim 6, wherein the end of the rib-shaped section is of semicircular shape in cross-section.

8. A high-pressure fuel reservoir according to claim 1, wherein the high-pressure fuel reservoir is manufactured from a drawn tube.

9. A high-pressure fuel reservoir according to claim 1, wherein the rib-shaped section projects inward a distance (D) of more than 2 mm compared to the cylindrically shaped inner surface of the longitudinal recess.

10. A high-pressure fuel reservoir according to claim 1, wherein the plurality of rib-shaped sections are disposed at the same angular distance with respect to one another on the inner surface of the longitudinal recess.

11. A high-pressure fuel reservoir according to claim 1, wherein at least two connection bores have an angular distance (WA in degrees °) which is a multiple of (k) of 360° divided by the number (n) of rib-shaped sections.

* * * * *